US005980654A

United States Patent [19]

Quadakker

[11] Patent Number: 5,980,654

[45] Date of Patent: Nov. 9, 1999

[54] OXIDATION-RESISTANT TI-AL CONTAINING ALLOY

[75] Inventor: Willem J. Quadakker, Wijnandsrade, Netherlands

[73] Assignee: Forschungszentrum Jülich GmbH, Júlich, Germany

[21] Appl. No.: 09/037,384

[22] Filed: Mar. 10, 1998

[30] Foreign Application Priority Data

Mar. 14, 1997 [DE] Germany ..... 197 10 592

[51] Int. Cl.[6] ..... C22C 14/00

[52] U.S. Cl. ..... 148/421; 148/668; 420/418

[58] Field of Search ..... 148/421, 437, 148/438, 703, 708, 668; 420/418, 552

[56] References Cited

U.S. PATENT DOCUMENTS 5,368,660 11/1994 Durlu et al. ..... 148/421

*Primary Examiner*—Sikyin Ip
*Attorney, Agent, or Firm*—Klaus J. Bach

[57] ABSTRACT

An alloy on the basis of γ-TiAl with an addition of the elements Re and Pd, which have a low oxygen affinity and/or one of elements X consisting of Ag, Cu, and Au, which are capable of forming compounds of the type $AlX_4$ with aluminum and, if present, are present in the amounts of 2.5–20 At- % Re, 5–20 At- % Cu, or 5–20 At- % Ag, such an alloy having excellent oxidation resistance in combination with low density and high strength.

3 Claims, No Drawings

OXIDATION-RESISTANT TI-AL CONTAINING ALLOY

BACKGROUND OF THE INVENTION

The invention relates to an alloy on the basis of the intermetallic phase γ-TiAl and to a method of making such an alloy.

Such an alloy consists mostly of the γ-TiAl phase and is known, for example from the publication "N. Zheng, W. Fischer, H. Grübmeier, V. Shemet, W. J. Quadakkers—'THE SIGNIFICANACE OF SUB-SURFACE DEPLETION LAYER COMPOSITION FOR THE OXIDATION BEHAVIOUR OF γ-TITANIUM, Script Metall. et Mater. 33(1995) 47–53".

The alloy finds more and more use as a construction material for high temperature components. When compared with conventional materials, γ-TiAl alloys offer great advantages in building components for which a combination of high strength and low density is required such as in stationary gas turbines and in jet propulsion engines.

An obstacle preventing the widespread introduction of the γ-TiAl alloys is their insufficient oxidation resistance at temperatures above about 700° C. The reason herefor is that, inspite of a high Al content of 42 to 55% Al (generally 48–50%), the γ-TiAl alloys do not form slowly growing protective $Al_2O_3$ layers during high temperature applications. Rather $TiO_2$ rich mixed oxide layers with high growth rates are formed resulting in relatively high wall thickness losses of the components which is unacceptable for long term applications.

It has become known in the meantime that no protective $Al_2O_3$ layer is formed because of the presence of $\alpha_2$-$Ti_3Al$ in the depletion zone immediately beneath the surface oxide layer. The $\alpha_2$ phase has a very high oxygen solubility (≈20 At.- %), so that the Al oxide occurs as internal oxidation rather than forming a protective surface layer.

Several authors have shown that the growth rate of the heterogeneous, $TiO_2$ rich oxide layers can be reduced by additions to the alloy of Mo, Cr, and particularly Nb(2–5 At.-%). However, inspite of this improvement, the oxidation resistance of these ternary or quaternary alloys is still insufficient for use at temperatures above about 800° C.

It has been known for some time that, in the initial stages of the oxidation of γ-TiAl alloys, protective layers on the basis of $Al_2O_3$ can actually be formed. However, these protective layers, particularly in $N_2$ containing process gases (for example air), have no long-term stability. Already after relatively short operating periods (of for example ≦100 h, depending on the temperature), a conversion to rapidly growing $TiO_2$-rich layers occurs.

From the printed publication, "N. Zheng, et al." referred to earlier, it is known that the formation of an initially protective $Al_2O_3$ layer is caused by a different composition of the depletion zone just below the oxidation layer. While there is $\alpha_2$-$Ti_3Al$ beneath the non-protective layer, as mentioned above, the depletion zone below the initial $Al_2O_3$ layer consists of a previously unknown ternary Ti—Al—O phase of an approximate composition $Ti_3Al_3O_2$ (designated a Z-phase) which possesses a cubic structure. Thermodynamic and kinetic considerations show that $Al_2O_3$ is stable in equilibrium with the Z-phase, since the last mentioned has a greater Al activity and a lower oxygen solubility than $\alpha_2$. Because of the structural properties of the Z-phase, which have in the meantime been determined, methods for the long term stabilization of this phase in the depletion zone below the protective $Al_2O_3$ based layer can be derived.

This knowledge provides the possibility of developing γ-TiAl alloys with greatly improved oxidation resistance.

It is the object of the invention to provide oxidation resistent, long term stable TiAl alloys.

SUMMARY OF THE INVENTION

This is obtained by an alloy on the basis of γ-TiAl with an addition of elements, which have a low oxygen affinity and/or elements X, which are capable of forming wit aluminum alloys of the type $AlX_4$ including alloys having at least one of at least 2.5 At- % Re, up to 5 At- % Cu, and 5 to 20 At- % Ag.

The oxidation resistance is achieved by alloy additions which stabilize the (cubic) Z-phase ($Ti_5Al_3O_2$) in the system Ti—Al—O. This concerns particularly elements which form compounds of the type $AlX_4$ (X=Ag,Cu or Au) with aluminum but also elements Y with very low oxygen affinity such as Re or Pd.

A binary alloy on the basis of γ-TiAl, that is, titanium with the addition of aluminum in the amount of 42–55 At- % is an example for an alloy which is based on TiAl in the sense of the invention. This alloy includes an addition of one or several alloying elements X and/or Y, which stabilize the Z-phase mentioned above. The concentration of the added alloy elements should be at least 2 At- % in order to provide for the desired effect. 20 At % should not be exceeded, since then additional phases could form ($TiX_n$, $AlX_m$) which would make the alloy brittle. A concentration of 3–10 At- % of added X and/or Y alloying elements leads to alloys which, on one hand, are oxidation resistant and, on the other hand, show practically no undesirable changes regarding their mechanical properties.

Another example is a multi-component alloy on the basis of TiAl which, according to the invention, in addition to Ti and Al and the X and/or Y elements, contain alloying elements which provide improved mechanical properties in respect to ductility or creep resistance. As addition Cr, Mn or B may be considered. The Cr or Mn content in the alloy is then preferably below 3 wt %, that of B below 500 ppm.

A multi-component alloy on the basis of γ-TiAl which, in addition to Ti and Al, contains oxidation inhibiting elements such as Mo, W and/or Nb represents another embodiment of the invention. The amount of Mo, W and/or Nb in the alloy should not exceed 5 At- %.

Binary or multi-component alloys on the basis of γ-TiAl with the previously mentioned additions of the elements X or Y represent another embodiment of the invention. Before its technical use, the alloy is pre-oxidized in a nitrogen-free atmosphere particularly in $O_2$, Ar—$O_2$, $H_2/H_2O$ at temperatures of between 700 and 1000° C. for 1–25 hours. With this preoxidation, the Z-phase beneath the oxide scale on Al-oxide basis is additionally stabilized.

The required preoxidation time decreases with increasing preoxidation temperature. With the earlier mentioned alloys for example, it is typically 2 hours at 900° C. and 5 hours at 800° C.

An example for a binary alloy is Ti—48Al—5Ag, an example for a ternary alloy is Ti—48Al—2Cr—5Ag and for a ternary alloy with an oxidation inhibiting element Ti—48Al—2Nb—5Ag or Ti—47Al—2Nb—2Cr—5Ag. The amounts are given in At- %.

What is claimed is:

1. An alloy on the basis of γ-TiAl including 42–55 At % Al and at least one of the element Re and Pd, which have a low oxygen affinity and at least one of the elements X comprising Ag, Cu, and Au, which form with aluminum compounds of $AlX_4$, said elements being present in the alloys in the amounts of: 8–20 At- % Pd, 2.5–20 At- % Re, 5–20 At- % Cu, and 5–20 At- % Ag.

2. A construction component consisting of an alloy as defined in claim 1.

3. A process of making an oxidation resistant alloy, wherein an alloy as defined in claim 1, is preoxidized at temperatures of between 700 and 1000° C. in a nitrogen-free atmosphere for 1–25 hours.

* * * * *